US009819130B2

(12) United States Patent
Lindkamp

(10) Patent No.: US 9,819,130 B2
(45) Date of Patent: Nov. 14, 2017

(54) MODULAR HOUSING OUTPUT SYSTEM

(71) Applicant: HARTING Electronics GmbH, Espelkamp (DE)

(72) Inventor: Marc Lindkamp, Luebbecke (DE)

(73) Assignee: HARTING ELECTRONICS GMBH (DE)

( * ) Notice: Subject to any disclaimer, the term of this patent is extended or adjusted under 35 U.S.C. 154(b) by 0 days.

(21) Appl. No.: 15/309,755

(22) PCT Filed: Jul. 1, 2015

(86) PCT No.: PCT/DE2015/100273
§ 371 (c)(1),
(2) Date: Nov. 8, 2016

(87) PCT Pub. No.: WO2016/008472
PCT Pub. Date: Jan. 21, 2016

(65) Prior Publication Data

US 2017/0250506 A1 Aug. 31, 2017

(30) Foreign Application Priority Data

Jul. 18, 2014 (DE) ..... 10 2014 110 095

(51) Int. Cl.

| | |
|---|---|
| ***H01R 13/60*** | (2006.01) |
| ***H01R 13/74*** | (2006.01) |
| ***H01R 12/70*** | (2011.01) |
| ***H01R 35/04*** | (2006.01) |

(52) U.S. Cl.
CPC ..... *H01R 13/74* (2013.01); *H01R 12/7064* (2013.01); *H01R 35/04* (2013.01)

(58) Field of Classification Search
CPC ..... H01R 35/04; H01R 12/7064; H01R 13/74
USPC ..... 439/562, 76.1, 751, 77, 67
See application file for complete search history.

(56) References Cited

U.S. PATENT DOCUMENTS

| | | | | |
|---|---|---|---|---|
| 2008/0003847 | A1* | 1/2008 | Lappoehn | H01R 12/716 439/74 |
| 2014/0127936 | A1* | 5/2014 | Leroyer | H01R 13/60 439/527 |

FOREIGN PATENT DOCUMENTS

| | | | |
|---|---|---|---|
| DE | 4418961 | 12/1995 | H01R 13/74 |
| DE | 102006030712 | 1/2008 | H01R 12/20 |
| DE | 102007018762 | 9/2008 | H01R 13/41 |
| EP | 0685909 | 12/1995 | H01R 13/74 |
| EP | 1424750 | 6/2004 | H01R 35/00 |

OTHER PUBLICATIONS

International Preliminary Report on Patentability issued in application No. PCT/DE2015/100273, dated Feb. 2, 2017 (8 pgs).

(Continued)

*Primary Examiner* — Abdullah Riyami
*Assistant Examiner* — Nelson R Burgos-Guntin
(74) *Attorney, Agent, or Firm* — Hayes Soloway P.C.

(57) ABSTRACT

Provided is a modular housing output system provided for conducting electronic signals out of a housing by electric contacts. The modular housing output system boasts a particularly large panoply of variants as a result of the modular use of different housing output ports. Housing output ports providing very different connection possibilities can be connected to the housing via a uniform interface.

10 Claims, 4 Drawing Sheets

(56) References Cited

OTHER PUBLICATIONS

International Search Report and Written Opinion with English translation issued in corresponding application No. PCT/DE2015/100273, dated Oct. 10, 2015 (10 pgs).
German Office Action (no translation) issued in application No. 10 2014 110 095.6, dated Dec. 29, 2016 (4 pgs).

* cited by examiner

MODULAR HOUSING OUTPUT SYSTEM

BACKGROUND OF THE INVENTION

The invention is based on a modular housing outlet system.

Housing outlets of this kind are required in order to carry signals and currents out of housings. Said housings can be an extremely wide variety of housings or devices which are intended to be provided with a connection.

Different requirements are made of housing outlets depending on the housing and application. For example, there are housings on which a plug-type connector is provided as the housing outlet. A mating plug can be connected to the housing by means of the plug-type connector and signals and currents can be relayed out of the housing.

Different types of plug-type connectors are used depending on the types of housing, signals and currents and also application. The choice of high-pole or low-pole plug-type connectors, round plug-type connectors or rectangular plug-type connectors, with a screw closure, bayonet-fitting closure or latching closure, depends on the respective application, the housing or else the user requirements in this case.

In another application, a cable which serves as a housing outlet is routed out of the housing. In this case, the cable is connected to further components in the housing and is routed through the housing wall. A seal is generally provided at the bushing in order to prevent the ingress of environmental influences.

However, the solutions for housing outlets known from the prior art have disadvantages which arise substantially due to the inflexible usability of the outlets. The entire housing has to be prepared and configured differently depending on the application.

Routing a cable through the housing wall requires a housing outlet other than a plug-type connector which is incorporated into the housing wall. Depending on the size of the plug-type connector used, the opening in the housing has to be of different dimensions and different fastening means have to be provided.

In addition, different connection options have to be provided within the housing for each type of housing outlet, be it a plug-type connector or a cable. Therefore, different components also have to be installed and kept available in the housing for different housing outlets.

OBJECT OF THE INVENTION

The object of the invention is to present a housing outlet which can be used in a variable manner for different applications. In this case, as few different parts as possible should have to be kept available in order to provide as large a range of different outlet variants as possible.

SUMMARY OF THE INVENTION

The invention relates to a modular housing outlet system, comprising a housing with an outlet opening, a printed circuit card and a housing outlet port. In this case, the outlet opening is provided in a side wall of the housing in order to allow access to the housing interior.

The printed circuit card is provided in the housing interior and fastened in the housing. In this case, the printed circuit card can be fastened in the housing by a locking connection, screw connection, adhesive bonding connection or clamping connection. Other fastening options could also be realized here.

At least one bore is provided in the printed circuit card, wherein the bore is in the form of a press-in zone for press-in contacts. In this case, the press-in zone is electrically conductively connected to electrical lines on the printed circuit card. The printed circuit card expediently has a large number of press-in zones for the connection of electrical contacts.

The printed circuit card is expediently arranged in the housing such that access to the press-in zones on the printed circuit card is possible through the outlet opening in the housing. This allows press-in contacts to be inserted into the press-in zones without the housing having to be opened.

At least one electrical contact is provided in the housing outlet port. In this case, the electrical contact is held in the housing outlet port in a captive manner. This can be realized, for example, by corresponding locking of the electrical contact in the housing outlet port. As an alternative, the housing outlet port, comprising a polymer, can also be injection-molded or cast around the at least one electrical contact in order to produce a unipartite housing outlet port.

The housing outlet port has a housing connection side and a cable outlet side. In this case, the housing outlet port is of substantially cylindrical design, wherein the housing connection side and the cable outlet side are located at the opposite ends of the cylindrical body.

In this case, the device connection side of the device output port is formed so as to correspond to the outlet opening in the housing. This allows the device outlet port to be connected to the housing. In this case, latching means which likewise correspond and can be locked to one another are expediently provided on the device connection side and at the outlet opening.

An interlocking configuration of the device connection side and the outlet opening prevent rotation in relation to one another.

The at least one electrical contact which is held in the housing outlet port passes through the housing outlet port from the device connection side as far as the cable outlet side. In this case, the at least one electrical contact is designed in such a way that it forms at least one press-in region. The press-in region is provided on the device connection side of the device outlet port and protrudes out of the device outlet port.

The modular housing outlet system is provided in such a way that the large number of press-in zones which are provided on the printed circuit card are accessible through the outlet opening. By virtue of insertion of the housing outlet port, the press-in regions of the electrical contacts make contact with the press-in zones on the printed circuit card. At the same time, the housing connection side of the housing outlet port locks in the outlet opening.

During the contact-making operation, contact is made with different press-in regions, which are provided on the printed circuit card, depending on the number of electrical contacts the housing outlet port is equipped with and the position of the electrical contacts in the housing outlet port.

The cable outlet side of the housing outlet port can be designed differently depending on the application. In one possible embodiment, the cable outlet side is provided for making contact with a plug-type connector. To this end, the cable outlet side has mechanical connecting means, such as, for example, a thread or latching means to which a plug-type connector can mechanically lock. The electrical contacts which are held in the housing outlet port serve, on the cable outlet side, as plug-type contacts for the plug-type connector.

In a further embodiment, a cable which is directly connected to the electrical contacts is provided on the cable outlet side of the housing outlet port. The cable can be routed away from the housing directly, without additional assembly.

A special embodiment provides that the cable outlet side is of multipartite design. In this case, the cable outlet side and the housing connection side are connected to one another such that they can rotate. Therefore, the orientation of the cable outlet side in relation to the housing can be varied.

The modular housing outlet system according to the invention allows housings to be equipped with different connection options in a variable manner. By virtue of a standard connection, which is provided in the housing, on the printed circuit card, different, pre-configured housing outlet ports can be connected to the housing in a rapid manner and without a great deal of complexity.

BRIEF DESCRIPTION OF THE DRAWINGS

An exemplary embodiment of the invention is illustrated in the drawings and will be explained in greater detail in the text which follows. In the drawings.

DETAILED DESCRIPTION OF THE INVENTION

The figures contain partially simplified, schematic illustrations. In some cases, identical reference symbols are used for elements which are similar but may not be identical. Different views of the same elements may be drawn to different scales.

Figure 1:
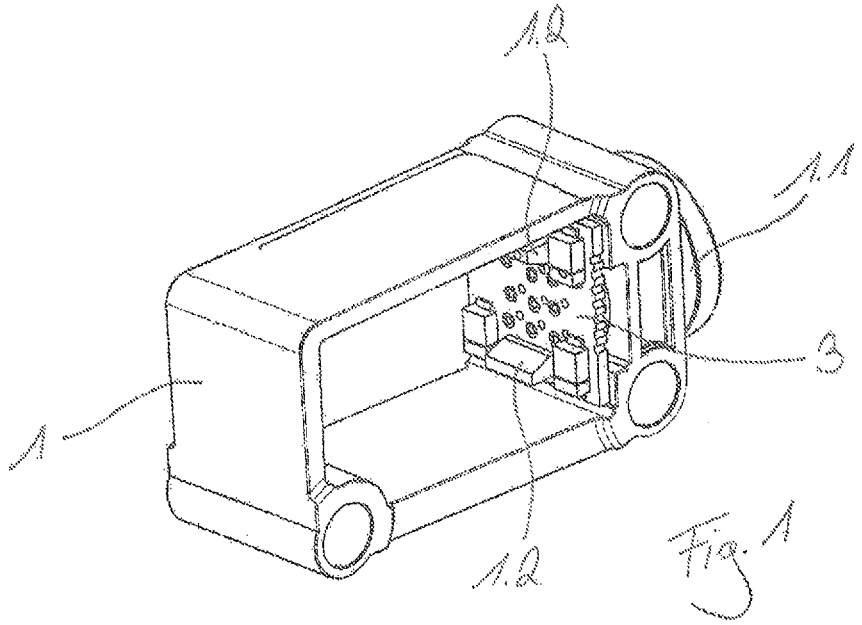
FIG. 1 shows a housing with a printed circuit card.

FIG. 1 shows a housing 1 of a modular housing outlet system with a printed circuit card 3. The housing 1 is illustrated such that it is open at the side in order to allow the interior of the housing 1 to be illustrated. An outlet opening 1.1 is integrally formed in the rear region, illustrated on the right-hand side, of the housing 1. The outlet opening 1.1 is provided for holding a housing outlet port 4 in order to connect said housing outlet port to the housing 1.

The printed circuit card 3 is provided in the interior of the housing 1. According to the invention, the printed circuit card 3 is arranged in front of the outlet opening 1.1. Two latching means 1.2 which lock and fix the printed circuit card 3 are expediently integrally formed with the housing 1. The arrangement of the printed circuit card 3 in front of the outlet opening 1.1 allows access to the printed circuit card 3 through the outlet opening 1.1.

Figure 2:
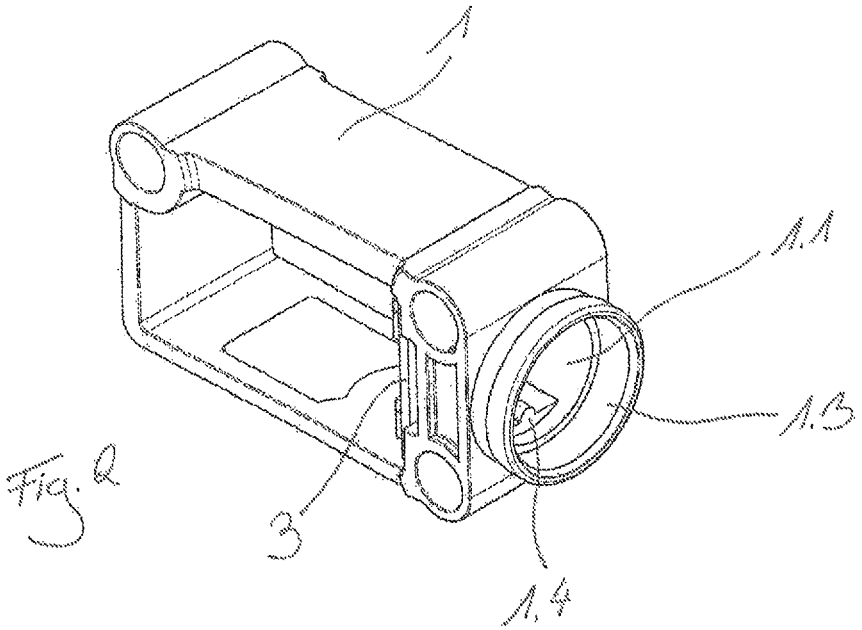
FIG. 2 shows a different view of the housing with a printed circuit card from FIG. 1.

The housing 1 with the printed circuit card 3 is illustrated from a further view in FIG. 2. The printed circuit card 3 in the housing 1 can be seen through the outlet opening 1.1. The outlet opening 1.1 is provided with a circumferential collar 1.3 on the outer side of the housing 1. Said circumferential collar is provided for holding a housing outlet port 4 in a more effective and more mechanically stable manner.

A coding 1.4 is additionally integrally formed in the outlet opening 1.1. Said coding 1.4 can also be found in a complementary manner on the housing outlet port 4 as coding 4.4. Rotation of the housing outlet port 4 in the outlet opening 1.1 is prevented by the complementary codings 1.4 and 4.4.

Figure 3A:
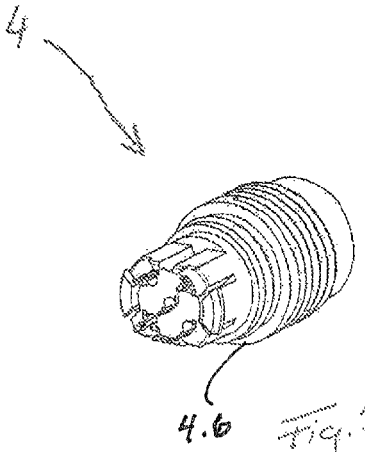
FIG. 3*a* shows a housing outlet port.

A housing outlet port 4 is illustrated in FIG. 3*a*. Said housing outlet port has a housing connection side 4.1 and a cable outlet side 4.2. The housing connection side 4.1 is illustrated in the rear, right-hand-side region in FIG. 3*a*. The cable outlet side 4.2 can be seen in the front, left-hand-side region.

This embodiment has, on the cable outlet side 4.2, a thread 4.3 which serves to fasten a plug-type connector by way of a screw connection. As an alternative, other fastening means for plug-type connectors can also be provided here.

A seal 4.6 which is held in a groove as a sealing ring is arranged in the central region of the cylindrical housing outlet port 4. In the fitted state, the seal 4.6 seals off the gap between the outlet opening 1.1 in the housing 1 and the housing outlet port 4.

The coding 4.4 which engages into the coding 1.4 of the outlet opening 1.1 in an interlocking manner is provided in the upper region on the housing connection side 4.1. Rotation of the housing outlet port 4 and the housing 1 in relation to one another is prevented in this way.

Two opposite latching means 4.5 are provided in the front region on the housing connection side 4.1. These latching means 4.5 allow the housing outlet port 4 to be locked in the housing 1. To this end, the latching means 4.5 engage into the housing 1 through the outlet opening 1.1 in the fitted state and lock on the housing inner side.

Here, five press-in regions 5.1 of electrical contacts 5 extend out of the housing outlet port 4 on the end side of the housing connection side 4.1. The electrical contacts 5 are held lengthwise in the housing outlet port 4. In this exemplary embodiment, the electrical contacts 5 have been encapsulated by the housing outlet port 4.

Figure 3B:
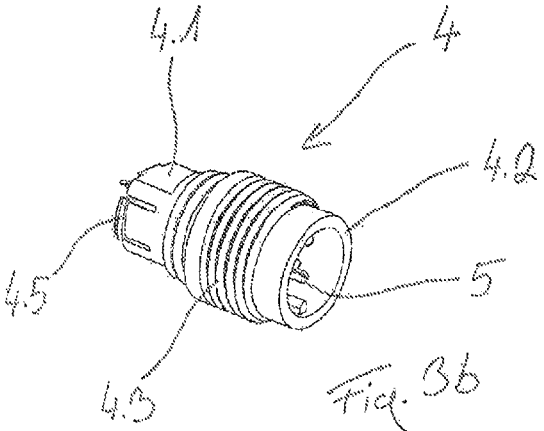
FIG. 3*b* shows a different view of the housing outlet port from FIG. 3*a;*

FIG. 3*b* shows the housing outlet port 4 from FIG. 3*a* once again, but looking at the cable outlet side 4.2. In this exemplary embodiment, the cable outlet side 4.2 is provided for making contact with a plug-type connector.

The electrical contacts 5 protrude into the cable connection side 4.2 as pin contacts. The cable connection side 4.2 is surrounded by the thread 4.3 for the purpose of fixing a plug-type connector.

Figure 4:
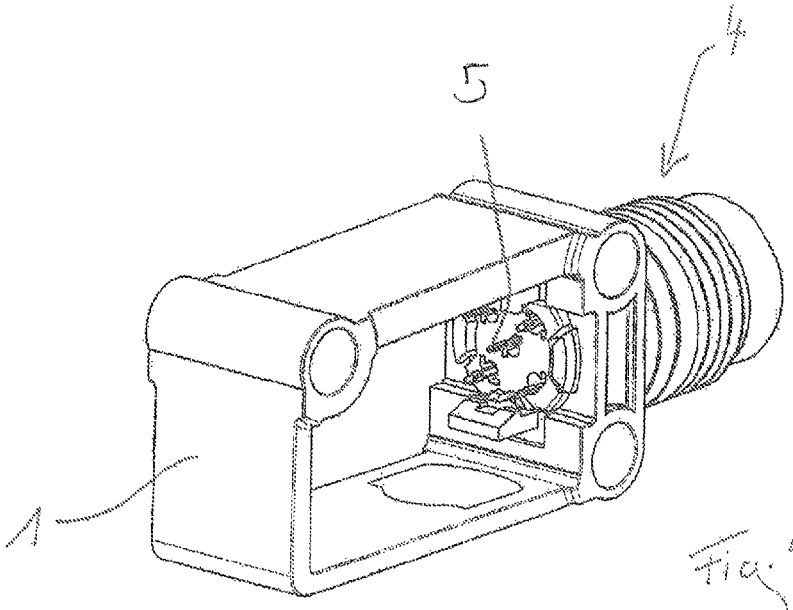
FIG. 4 shows a housing with a housing outlet port.

The housing 1 from FIG. 1 is once again illustrated in the same view in FIG. 4, but without a printed circuit card 3 and with the housing outlet port 4 inserted. For this purpose, the housing connection side 4.1 of the housing outlet port 4 is inserted into the outlet opening 1.1. The collar 1.3 provides a sufficient degree of stability between the housing 1 and the housing outlet port 4.

The latching means 4.5 of the housing outlet port 4 engage behind the outlet opening 1.1 on the inner side of the housing 1. The housing outlet port 4 is prevented from falling out of the outlet opening 1.1 in this way.

The electrical contacts 5 can be seen on the end side of the housing connection side 4.1, which end side is situated in the housing 1. Said electrical contacts project into the interior of the housing 1 by way of their press-in regions 5.1.

Figure 5:
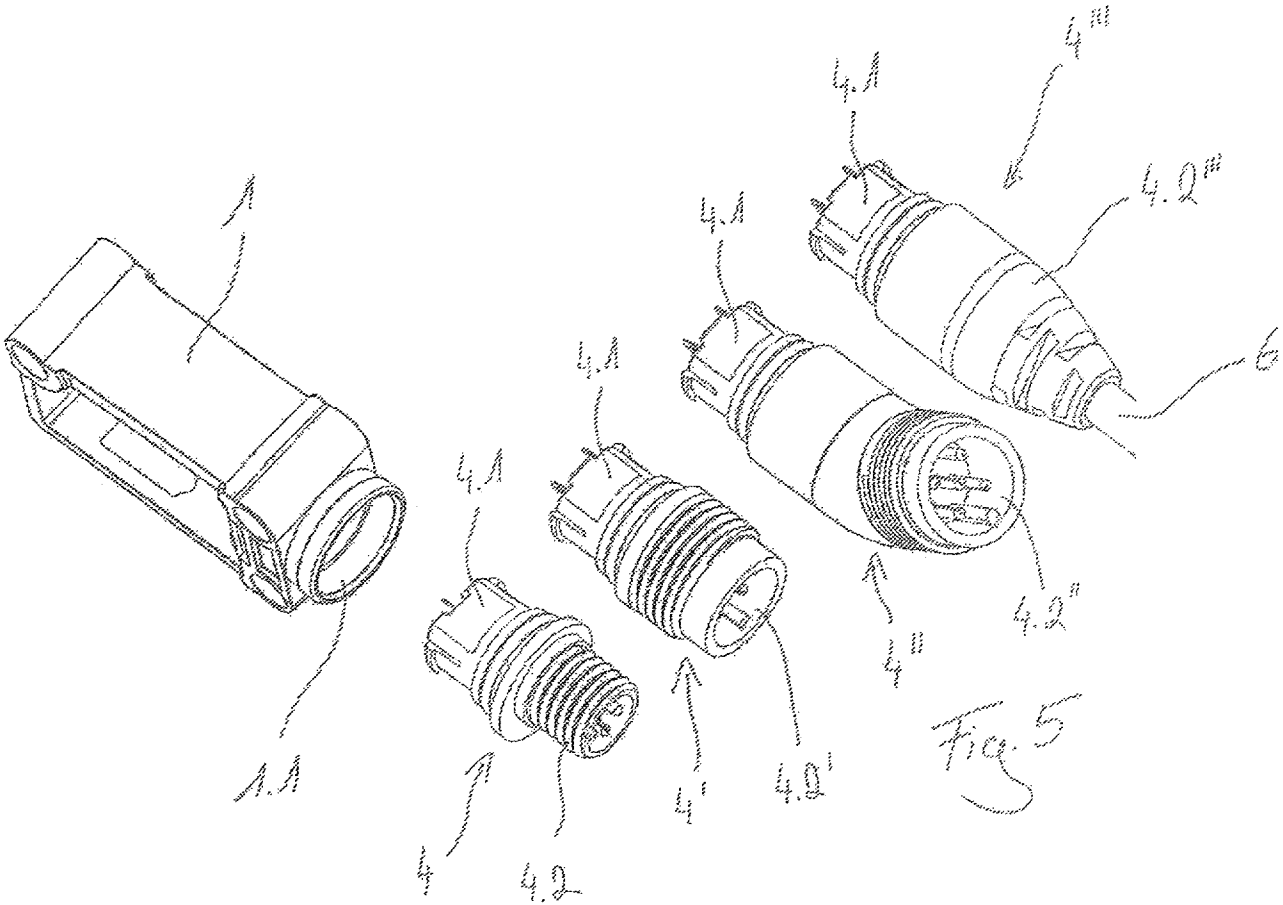
FIG. 5 shows a modular housing outlet system.

A housing outlet system according to the invention is illustrated in FIG. 5. Said housing outlet system comprises a housing 1 as already shown in the preceding figures and also comprises a printed circuit card 3 which is held in said housing. The outlet opening 1.1 for holding a housing outlet port 4 is provided at the front region of the housing 1.

FIG. 5 further shows a range of four housing outlet ports 4, 4', 4", 4'" of differing design. All variants of the housing outlet port 4, 4', 4", 4'" have an identical housing connection side 4.1. Said housing connection side can be held and locked in the outlet opening 1.1 in the housing 1.

The cable outlet sides 4.2, 4.2', 4.2", 4.3'", however, are of differing design. The cable outlet side 4.2 is provided for a four-pole screw- and plug-type connector. The cable outlet side 4.2' is likewise provided for a screw- and plug-type connector, but with a larger diameter and five poles. The same screw- and plug-type connector can be fitted to the cable outlet side 4.2", but this is provided on the housing outlet port 4" at an angle and such that it can rotate. A cable 6 is directly connected to the housing outlet port 4'" in the cable outlet region 4.2'" and encapsulated by the housing outlet port 4'".

The large number of press-in zones 3.1 are provided on the printed circuit card 3 in order to allow the press-in regions 5.1 to make contact with the different housing outlet ports 4, 4', 4", 4'". Said press-in zones are arranged on the printed circuit card 3 such that press-in regions 5.1 make contact with different press-in zones 3.1 depending on the housing outlet port 4, 4', 4", 4'". Two possible operations in which press-in regions 5.1 make contact with press-in zones 3.1 are shown by way of example in FIGS. 6*a* and 6*b*.

Figure 6A:
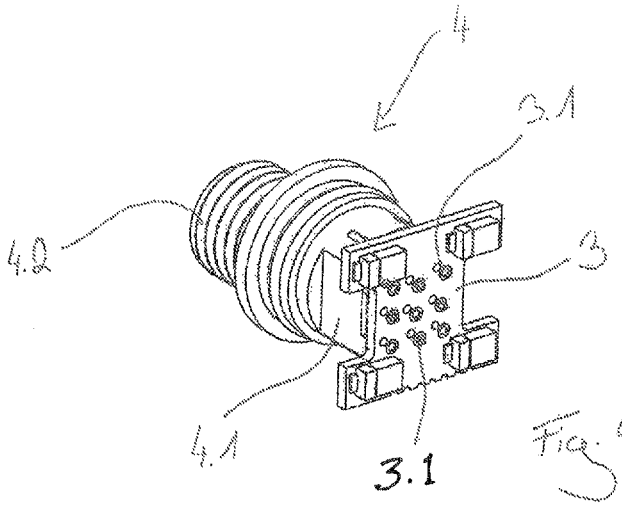
FIG. 6*a* shows a housing outlet port with a printed circuit card.

FIG. 6*a* shows the printed circuit card 3 with contact made by the housing outlet port 4. The printed circuit card 3 has nine press-in zones 3.1 which are provided for making electrical contact and are arranged in three rows of in each case three press-in zones 3.1. The housing outlet port 4 accommodates four electrical contacts 5. The four press-in regions 5.1 of the electrical contacts 5 make contact with the press-in zones 3.1 which are respectively situated at the top, at the bottom, on the right-hand side and on the left-hand side. The press-in zones 3.1 in the corners, and also the central press-in zone 3.1 remain free in the case of this housing outlet port 4.

Figure 6B:
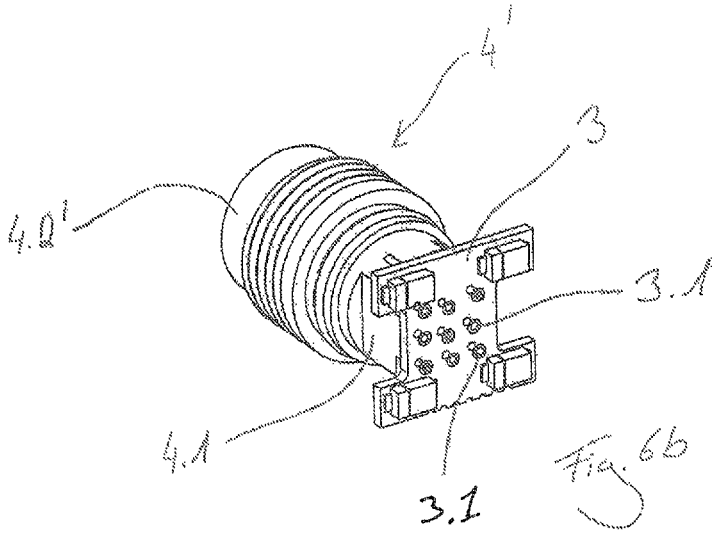
FIG. 6*b* shows a further housing outlet port with a printed circuit card.

In FIG. 6*b*, the housing outlet port 4' makes contact with the printed circuit card 3. Since said housing outlet port, as already described in FIG. 6, has five electrical contacts 5, contact has to be made with other press-in zones 3.1 of the printed circuit card 3. In this case, press-in regions 5.1 of the electrical contacts 5 make contact with the press-in zones 3.1 in the corners and also the central press-in zone 3.1.

Therefore, contact can be made with different press-in zones 3.1 on the printed circuit card 3 depending on design, size and number of contacts. The modular housing outlet system therefore has a particularly high degree of flexibility and a large number of connection variants.

LIST OF REFERENCE SYMBOLS

1 Housing
1.1 Outlet opening
1.2 Latching means
1.3 Collar
1.4 Coding
3 Printed circuit card
3.1 Press-in zone
4 Housing outlet port
4.1 Housing connection side
4.2 Cable outlet side
4.3 Thread
4.4 Coding
4.5 Latching means
4.6 Seal
5 Electrical contact
5.1 Press-in region
6 Cable

The invention claimed is:

1. A modular housing outlet system, comprising a housing with an outlet opening, a printed circuit card which is arranged in the housing and also a housing outlet port, wherein the housing outlet port having a housing connecting side and a cable outlet side, the housing outlet port having a plurality of electrical contacts extending through the housing outlet port the housing connection side to the cable outlet side, the plurality of electrical contacts are held in the housing outlet port in a captive manner, the printed circuit card has a plurality of bores which are in the form of press-in zones, the printed circuit card is arranged within the housing in front of the outlet opening, the press-in zones of the printed circuit card are accessible through the outlet opening in the housing, the housing connection side of the housing outlet port is designed such that it corresponds to the outlet opening in the housing in a form-fitting manner and can be locked in the outlet opening in the housing, the electrical contacts form press-in contacts on the housing connection side of the housing outlet port, and are provided for pressing into at least one of the press-in zones, wherein the plurality of press-in zones is greater in number than the plurality of electrical contacts, wherein the press-in contacts make contact with some of the press-in zones, with other press-in zones being free, depending on the configuration of the housing outlet port.

2. The modular housing outlet system as claimed in claim 1, wherein the cable outlet side of the housing outlet port is designed to make contact with and to interlock with a plug-type connector.

3. The modular housing outlet system as claimed in claim 1, wherein on the cable outlet side of the housing outlet port an outgoing cable is provided which is connected to the at least one electrical contact.

4. The modular housing outlet system as claimed in claim 2, wherein the housing outlet port is of multipartite design, and the cable outlet side is provided such that it can rotate in relation to the housing connection side.

5. The modular housing outlet system as claimed in claim 3, wherein the housing outlet port is of multipartite design, and the cable outlet side is provided such that it can rotate in relation to the housing connection side.

6. The modular housing outlet system as claimed in claim 1, wherein the printed circuit card is locked in the housing.

7. The modular housing outlet system as claimed in claim 2, wherein the printed circuit card is locked in the housing.

8. The modular housing outlet system as claimed in claim 3, wherein the printed circuit card is locked in the housing.

9. The modular housing outlet system as claimed in claim 4, wherein the printed circuit card is locked in the housing.

10. The modular housing outlet system as claimed in claim 5, wherein the printed circuit card is locked in the housing.

* * * * *